US011306417B2

(12) United States Patent
Maksimov

(10) Patent No.: US 11,306,417 B2
(45) Date of Patent: Apr. 19, 2022

(54) BAST-FIBER MATERIAL PROCESSING METHOD

(71) Applicant: SYLER GIBRALTAR LIMITED, Gibraltar (GI)

(72) Inventor: Vladimir Vladimirovich Maksimov, Marta (RU)

(73) Assignee: SYLER GIBRALTAR LIMITED

( * ) Notice: Subject to any disclaimer, the term of this patent is extended or adjusted under 35 U.S.C. 154(b) by 453 days.

(21) Appl. No.: 15/502,802

(22) PCT Filed: Nov. 24, 2014

(86) PCT No.: PCT/RU2014/000885
§ 371 (c)(1),
(2) Date: Jul. 17, 2017

(87) PCT Pub. No.: WO2016/024880
PCT Pub. Date: Feb. 18, 2016

(65) Prior Publication Data

US 2017/0327975 A1 Nov. 16, 2017

(30) Foreign Application Priority Data

Aug. 13, 2014 (WO) ..... PCT/RU2014/000606

(51) Int. Cl.
*D01G 21/00* (2006.01)
*D06M 16/00* (2006.01)
(Continued)

(52) U.S. Cl.
CPC ..... *D01G 21/00* (2013.01); *D01C 1/02* (2013.01); *D06M 10/00* (2013.01);
(Continued)

(58) Field of Classification Search
CPC .... D06M 10/00; D06M 10/02; D06M 10/025; D06M 16/003; D01B 1/10–48; D01B 9/00; D01C 1/02
(Continued)

(56) References Cited

U.S. PATENT DOCUMENTS 3,852,031 A * 12/1974 Brodov ..... D01B 3/10 8/139
8,650,717 B2 * 2/2014 Hao ..... D01C 1/02 19/0.35
2009/0211894 A1 * 8/2009 Ribeiro De Almeida Carneiro Pacheco ..... D06B 19/00 204/165

FOREIGN PATENT DOCUMENTS

CN 101629322 A * 1/2010 ..... D01C 1/02
DE 19944905 A1 * 4/2001 ..... D01B 1/10
(Continued)

*Primary Examiner* — Khoa D Huynh
*Assistant Examiner* — Aiying Zhao
(74) *Attorney, Agent, or Firm* — Fay Sharpe LLP

(57) ABSTRACT

The invention relates to the textile industry, and specifically to methods for processing bast-fiber materials, for instance the fiber of flax, hemp, jute, nettle, kenaf, and others. The technical result which the present invention aims to achieve consists in: enhancing the quality of a cottonized fiber, when processing bast-fiber materials, by means of high-voltage electric pulse discharges following preliminary biochemical and final minimal mechanical processing; and in enhancing the physical/mechanical and spinning properties thereof, which, overall, allows for an optimized, efficient production process. Said technical result is achieved in that a bast-fiber material processing method includes a technological sequence of processes involving feeding raw material into a bale breaker, which is provided with a decompactor, and into a dosing system, processing using high-voltage electric pulse discharges, rinsing with emulsifying reagents, wash-
(Continued)

ing and press-drying in a drum-type installation, decompacting, final drying and light decompacting; the raw material is biochemically treated prior to being fed into high-voltage electric pulse discharge chambers.

9 Claims, 1 Drawing Sheet

(51) Int. Cl.
*D06M 10/02* (2006.01)
*D06M 10/00* (2006.01)
*D01C 1/02* (2006.01)
*D06M 101/06* (2006.01)

(52) U.S. Cl.
CPC ..... *D06M 10/025* (2013.01); *D06M 16/003* (2013.01); *D06M 2101/06* (2013.01)

(58) Field of Classification Search
USPC ..... 19/5 R, 7
See application file for complete search history.

(56) References Cited

FOREIGN PATENT DOCUMENTS

| | | | | |
|---|---|---|---|---|
| EP | 0107603 | | 5/1984 | |
| RU | 2132422 | | 6/1999 | |
| RU | 2280720 | | 7/2006 | |
| RU | 2489536 | C2 * | 8/2013 | |
| WO | WO9413868 | | 6/1994 | |
| WO | WO-2006073330 | A1 * | 7/2006 | ..... D01B 1/10 |

* cited by examiner

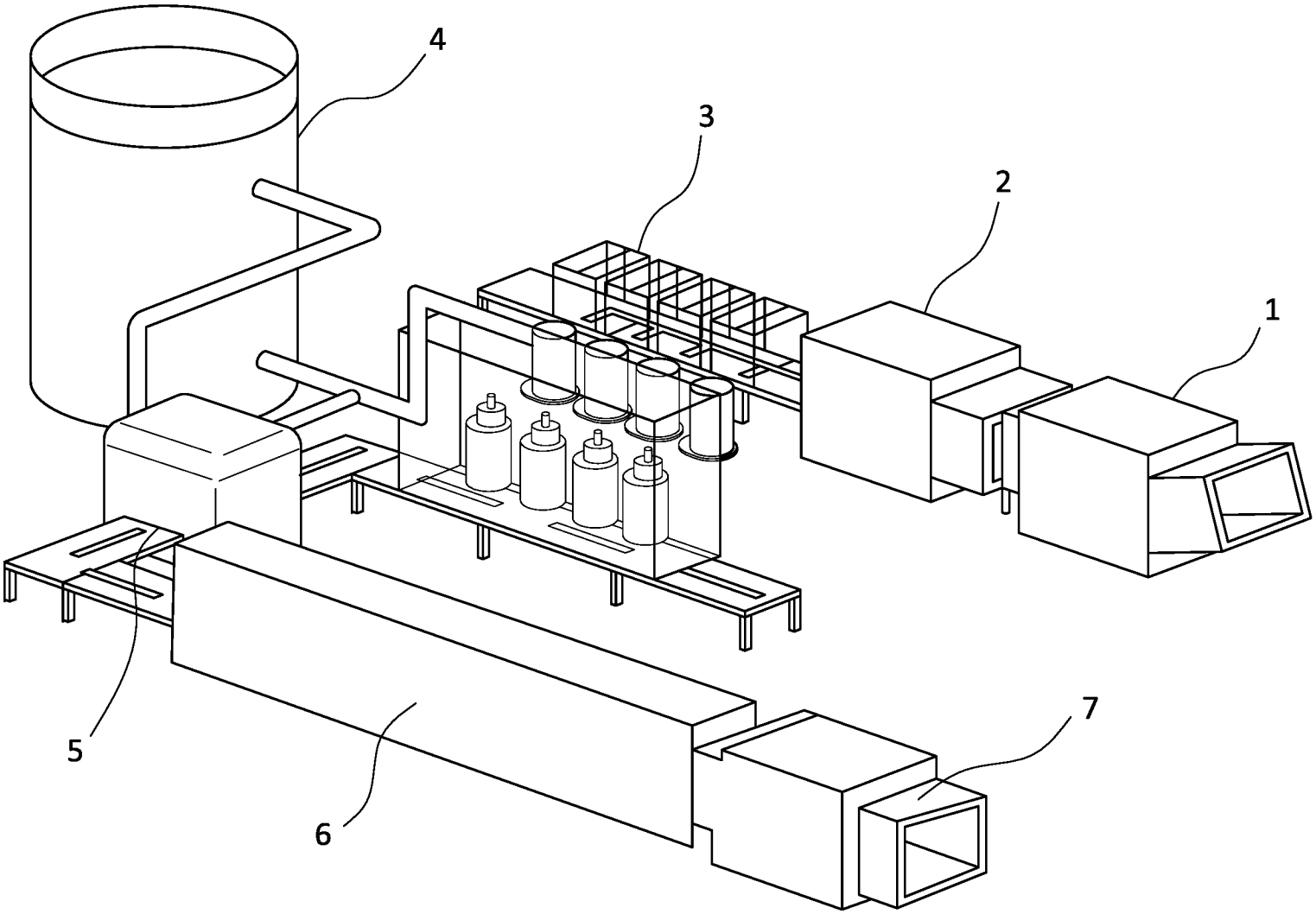
1
2
3
4
5
6
7

BAST-FIBER MATERIAL PROCESSING METHOD

FIELD OF INVENTION

The invention relates to the textile industry, and specifically to methods of processing bast-fiber materials, for example, fibers of flax, hemp, jute, nettles, kenaph and other plants.

PRIOR STATE OF THE ART

From the state of the art, various mechanical, chemical, biological, physical, physical-chemical and mechanical-chemical methods are known for the processing of bast-fiber materials to obtain the product set by the parameters of the technical process under which the fiber obtained is to be converted. Particular mention may be made of the methods disclosed in patents for inventions RU 2004663, RU 2083746, RU 2145986 and others.

These methods possess the following disadvantages: since processing of fibers for large-scale removal of incrustation products is carried out primarily via a chemical route, obtaining de-incrusted elementary fibers is accompanied by the breakdown and destruction of pectin substances and lignin, which constitute an extremely valuable raw material in many areas of industry. Moreover expensive equipment with a high metal content is required to put these methods into effect, and a large quantity of chemicals is also consumed, which takes this group of technologies into the realms of the most hazardous and environmentally harmful production processes. These methods also feature low technological effectiveness, which is caused by the lengthy duration of the processing to obtain the required end product quality.

The method of processing bast-fiber materials for which this application is made is based on the idea of using the morphological features of the raw material being processed, which comprises a woody part and elementary cellulose fibers combined into a dense, compact complex by central lamellae consisting of hemicellulose and lignin, pectin and other substances (nitrous, adipocere, dyeing, tanning, ash), known as incrusting substances, performing the role of a natural adhesive component. Some of the fibers are displaced lengthwise in such a way that the ends of the fibers that are located higher are inserted between the fibers that are lower down, partly creating a mesh.

The woody part and the fibers feature a high level of strength and flexibility, while the incrusting substances, which combine into a single whole the elementary fibers and their complexes, possess low strength and high rigidity. Such a structure, comprising components possessing diametrically opposed physical and mechanical properties and combined into a single whole, is classified as a composite material (a biopolymer).

The components, combined into a single structure and functioning as a single whole when mechanical forces are applied from outside, mutually supplement each other's properties, enabling high strength and rigidity of the initial bast-fiber raw material to be obtained simultaneously.

To obtain only textile raw material with spinning characteristics, however, the use of just one component is proposed—the residual fine fibrous complexes of the elementary fibres, retaining the ordered crystalline structure of cellulose. And in the ideal case full removal of incrusting substances, the lignified part and the waste impurities is proposed. Cottonization means bringing the fibers of bast-fiber crops to states that are close in terms of the physical/mechanical characteristics to cotton fibers and are acceptable for working on existing spinning equipment.

There are biological enzymatic treatment methods, both on their own and combined with mechanical/chemical methods of processing bast-fiber materials.

In patent for invention RU No. 2295592, published on 20 Mar. 2007, it is stated that one of the stages of preparation of flax raw material is its processing using various solutions to make subsequent mechanical processing easier. In this patent it is stated that the technical result is achieved by the use, in accordance with the invention, of culture filtrates of the microorganisms *Penicillium canescens* and *Trichoderma reesei* as enzymatic products with a set component ratio in a flax fiber processing solution containing enzymatic products, a surfactant, an intensifier and water.

From the state of the art there are also known patents for invention U.S. Pat. No. 8,603,802, published 10 Dec. 2013, and U.S. Pat. No. 8,591,701, published 26 Nov. 2013, in which methods of extracting fibers from bast-fiber material are described; these include preliminary processing of fiber after scutching using an aqueous solution containing trisodium citrate (sodium salt of citric acid) or mixtures of them with a pH in the range of around 8-14 at a temperature of around 90° C. or below, with subsequent processing using various enzymes and mechanical hackling.

The combined technology is described in the article "Enzymatic processing as a tool to obtain natural fibre" (Enzymatic Bioprocessing—New Tool of Extensive Natural Fibre Source, Utilization).

In addition, from the state of the art a patent for an invention RU No. 2124591 is known, published 10 Jan. 1999, which discloses a method of primary processing of flax characterized in that the short fiber obtained is treated to produce cottonized fiber in a chamber, using a method based on an aerobic microbiological process combined with drying during retting of fiber for a period of 72 h and drying to an 8-10% moisture content. After this the fiber is passed through the brake of a breaker-and-scutcher, a blower cyclone and a shaker 2-3 times. The effectiveness of this method is supported by the fact that producing cottonized fiber at a flax works will be a continuation of the production process of primary processing of flax making use of production areas there and already-available equipment (breaker-and-scutcher with shaker, tow-making unit with shaker and dryer).

Certain combinations of the enzymes pectinases, hemicellulase (xylanases) and cellulases enable the structure of bast-fiber material to be destructured as a biopolymer, since the binding substances break down faster than cellulose under the influence of the microorganisms, and the stability of the woody part of the stem—the scutch and the bast fiber tissue parenchyma residues—to be deliberately lowered for the further mechanical impact of scutching and fine cleansing.

Using X-ray investigation methods, however, the effect of the enzymes takes place only on the surface of the cellulose fibres and is not able to penetrate into the pores and nano-pores of individual fibrils. (Role of Polysaccharides on Mechanical and Adhesion Properties of Flax Fibres in Flax/PLA Biocomposite, International Journal of Polymer Science, Volume 2011 (2011), Article ID 503940, point 1, 11 pages.

It has also been established using a UV spectroscopy method that after scutching, the enzyme-modified short flax fibre is freed from the lignin component at a level of 50% (see e.g. A. Kareev, A. Cheshkova. Sposob kotonizatsii nizkosortnogo l'nianogo volokna [A method of cottonizing low-grade flax fibre]. 15 Aug. 2008, "V mire oborudovaniia" [In the world of equipment] 5(80)).

The following patents are known from the state of the art: RF 2371527, published 27 Oct. 2009, RF 2280720, published 27 Jul. 2006 and RF 2233355, published 27 Jul. 2004, in which processing of bast-fiber materials takes place via an electro-hydraulic effect exerted on the material being processed, which is in a liquid.

But both before and after the electro-hydraulic work the fiber is subjected to quite a strong mechanical impact: scutching, hackling, loosening, which significantly worsens the quality of the final cottonized fiber, specifically through shortening, breakdown of the super-short fibers that were there to begin with and, as a consequence, providing a product with a high linter content.

DISCLOSURE OF THE INVENTION

The technical result which the invention subject to application is designed to achieve consists in improving the quality of cottonized fiber when processing bast-fiber materials using high-voltage pulse electric discharges with preliminary biochemical and concluding minimal mechanical processing, and, as a result, improving its physical/mechanical and spinning properties, which, from the overall aspect, also helps to optimize the effectiveness of the production process.

This technical result is achieved by including in the method of processing of bast-fiber materials, where there is a technical sequence of processes of feeding of the raw material into a bale-breaker with a loosener and on to a metering system, processing using high-voltage pulse electric discharges, rinsing with emulsifying reagents, washing and pressing in a drum-type installation, loosening, final drying and fine loosening, before feeding the high-voltage pulse electric discharges into the chambers, the raw material undergoes biochemical processing. If necessary, the initial bast-fiber raw material is additionally processed using high-voltage electric discharges before the biochemical treatment to smooth the flow of the subsequent biochemical processes.

Furthermore, the method of processing bast-fiber materials may additionally include separation of biological and valuable substances out of the processed liquid medium from the high-voltage pulse electric discharge chambers.

The initial raw material in the method subject to application is fiber—an intermediate product of bast-fibre materials after biological enzymatic treatments, both separately and in combination with chemical methods of processing the bast-fiber materials without subsequent mechanical scutching.

The main feature of the new method of processing bast-fiber materials is the creation of a non-equilibrium state of the system: product being processed—environment which is created through the use of various and mechanical actions. This physical/mechanical action is applied after various preliminary biochemical treatments of the bast-fiber material.

The physical/mechanical action that is employed is a high-voltage pulse electric discharge in a liquid medium. The high-voltage pulse electric discharge between two electrodes in the liquid medium (for example, in water), without the presence of a combustible conductor between them, is accompanied by a multi-factorial complex of physical/mechanical and mechanical actions.

These are optical, ultraviolet, infrared and other electromagnetic radiations, ultrasonic and sound waves of a broad frequency range, oxidation-reduction processes and the shaping of shock waves. With a pulse electrical discharge in a liquid there is a rapid release of energy in the discharge channel and the pressure in it significantly exceeds the external pressure; the channel instantly expands at a rate of over 100 m/s, which leads to the occurrence of a shock wave and flows of liquid accompanied by very strong cavitation. These phenomena also give rise to a sharp increase in the area of the interface of the gaseous, liquid and solid phases, and consequently to a corresponding increase in the reaction capacity of the disperse phases that are present in the materials biopolymer. The influence of the above factors enables the processes of destruction of the initial raw material to be intensified through the impact on the microdynamics of the liquid reaction media, where, for example, water (appearance of active forms of oxygen from the water molecules present and, as a result of partial electrolysis with the discharges and cavitation) temporarily becomes a process catalyst and an active solvent of relatively-insoluble substances, even without the introduction of chemical reagents.

So this whole range of phenomena acts on the raw material subject to processing, subjecting it to intense selective destruction: to begin with the residual less strong and more rigid incrusting substances are broken down, and the woody part, while the extremely pliable and strong cellulose fibers are only insignificantly damaged.

By varying the parameters of the discharges, one may achieve complete removal of incrusting substances, ordering of the chaotic separation of the woody part and waste impurities and the potential to retain the original length and diameter of the complexes of individual fibers.

As practice has shown, this is significant, since immediate subsequent multiple hackling of the fibrous intermediate product after biochemical treatments simply very unevenly tears the still partially glued-together product, and also inevitably leads to shortening and further breakdown of the super-short fibers that were there from the start, and consequently to a resulting product with a high linter content.

It is specifically the combination of a sequence of biological treatments and high-voltage pulse discharges in a liquid medium that enables the amorphous layer of polysaccharides of the hemicellulose, pectins and lignins type to be completely removed. This multi-disciplinary approach makes it easier to separate out the woody part and the waste impurities, and gently undoes the separate bundles of technical fibers into fine fibrous complexes of elementary fibers while retaining their original length, diameter and the ordered crystalline structure of cellulose. Further mechanical processing on hackling machines enables cottonized fiber to be produced to the set parameters of the end user's production process.

The method for which the application is made ensures that high-quality cottonized fibre is produced through the processing of bast-fiber materials using high-voltage pulse electric discharges with preliminary biochemical and concluding minimal mechanical processing. It improves its physical/mechanical and spinning properties, which overall also helps to optimize the effectiveness of the production process using existing production areas and equipment.

BRIEF DESCRIPTION OF DRAWINGS

The essence of the invention is explained using a drawing, where, in FIG. 1, a diagram of the process line for bast-fiber material processing is depicted.

PUTTING THE INVENTION INTO EFFECT

The method of bast-fiber material processing for which the application is made is put into effect as follows.

The intermediate product, fiber from bast-fiber crops which has undergone preliminary processing using biochemical methods, passes to the cottonization process line, which comprises a bale-breaker and loosener (1) installed in the sequence of the production process. The next stage is the metering system (2), which works on a batch basis, and consists of pan-type scales of the Digi-Balance type, which is filled by the fiber that arrives from the bale-breaker, and discharges it as a set weight is reached (or a Truetzschler type EBWM belt metering chamber, made by Derux GmbH of Germany). Then a liquid, for example water, is fed into the high-voltage pulse electric discharge chambers (3) which are filled with the intermediate product, and in these chambers partial cottonization of the fiber takes place. The number of discharge chambers depends on the output of the whole complex, and they are located in a sound-proofed space.

The dimensions and geometry of the discharge chamber, the electrical parameters of the high-voltage pulse generator, the frequency of the pulses, the length (gap) and geometry of the inter-electrode space, the number of electrodes and their distribution in space, the ratio of the mass of liquid to the mass of raw material and other parameters are selected in such a way as to create the optimum conditions for development of sparkover and a shock wave configuration for effective modification of the initial materials and the best output of the installation as a whole. The discharges occur alternately (haphazardly) and are automatically regulated.

The discharge chambers are linked by the liquid feed pipes, and the used liquid passes with the aid of pumps to a filtration and recirculation system (4). After the end of the discharge cycle the chambers tip up and the processed fiber passes via a transporter to an industrial drum-type washing and drying installation (5), where rinsing, pressing and drying of the fiber takes place. To increase the elasticity and flexibility of the fiber, a plasticizing agent based on surfactants and surfactant-based emulsions is added to the washing and drying installation.

The washing and drying installation is also connected to the filtration and recirculation system (4).

The wet loosener unit, the dryer and a type EFO-IV or EMZH fine loosener made by Derux GmbH (Germany) for thorough and careful loosening of the natural fibers are located in section 6.

The line ends with a fiber press 7.

It has been established that Agata grade short fiber flax (Great Britain) processed using 400 discharges at an energy level for each discharge of 2.2 kJ is the most suitable for future spinning, since the fiber obtained was compatible in its mean diameter, mean length and short fiber content with American mountain cotton. Independent tests were carried out on the properties of both the fiber and the spinning capacity at the company Filartex SpA (Italy), which is one of the leading cotton processing companies in Europe.

It was also proven that increasing the discharge energy to 3.6 kJ gives the same results in terms of the quality of processed short flax fiber yield, and this quality may be achieved with a number of discharges of between just 100 and 200.

Breaking load tests on the yarn in a mixture with cotton 40% flax, Electra grade\60% cotton.

Yarn 74.2 tex, 100 repeats.

Appendix 3 Yarn tensile testing results

40/60 Flax (Electra variety)/Cotton yarn, 74.2 tex, 100 repeats

| Test No | Force at Break (N) | Elongation at Break (mm) | Force at Peak (N) | Elongation at Peak (mm) | Strain at Break (%) | Strain at Peak (%) |
|---|---|---|---|---|---|---|
| 1 | 7.68 | 28.17 | 7.96 | 27.27 | 5.63 | 5.46 |
| 2 | 8.51 | 30.81 | 8.51 | 30.81 | 6.16 | 6.16 |
| 3 | 6.87 | 32.60 | 8.96 | 31.70 | 6.52 | 6.34 |
| 4 | 4.15 | 33.49 | 10.26 | 32.58 | 6.70 | 6.52 |
| 5 | 10.33 | 34.38 | 10.33 | 34.38 | 6.88 | 6.88 |
| 6 | 9.76 | 33.45 | 9.76 | 33.45 | 6.69 | 6.69 |
| 7 | 6.29 | 33.44 | 9.52 | 32.55 | 6.69 | 6.51 |
| 8 | 3.22 | 29.88 | 8.02 | 28.96 | 5.98 | 5.79 |
| 9 | 10.11 | 34.38 | 10.11 | 34.38 | 6.88 | 6.88 |
| 10 | 10.88 | 37.06 | 10.88 | 37.06 | 7.41 | 7.41 |
| 11 | 5.32 | 32.45 | 9.82 | 31.56 | 6.49 | 6.31 |
| 12 | 8.28 | 29.91 | 8.28 | 29.91 | 5.98 | 5.98 |
| 13 | 5.60 | 30.67 | 8.22 | 29.77 | 6.14 | 5.95 |
| 14 | 8.95 | 33.51 | 9.32 | 32.61 | 6.70 | 6.52 |
| 15 | 3.49 | 34.36 | 9.15 | 33.44 | 6.87 | 6.69 |
| 16 | 10.21 | 31.66 | 10.21 | 31.66 | 6.33 | 6.33 |
| 17 | 7.67 | 27.14 | 7.67 | 27.14 | 5.43 | 5.43 |
| 18 | 4.55 | 32.43 | 9.67 | 31.52 | 6.49 | 6.30 |
| 19 | 4.72 | 30.70 | 8.65 | 29.79 | 6.14 | 5.96 |
| 20 | 4.93 | 36.17 | 11.24 | 35.26 | 7.24 | 7.05 |
| 21 | 5.48 | 33.47 | 9.24 | 32.55 | 6.69 | 6.51 |
| 22 | 3.35 | 34.35 | 9.79 | 33.44 | 6.87 | 6.69 |
| 23 | 9.04 | 31.67 | 9.04 | 31.67 | 6.33 | 6.33 |
| 24 | 7.91 | 28.97 | 7.91 | 28.97 | 5.79 | 5.79 |
| 25 | 4.34 | 32.44 | 8.94 | 31.53 | 6.49 | 6.31 |
| 26 | 7.97 | 29.78 | 7.97 | 29.78 | 5.96 | 5.96 |
| 27 | 6.38 | 29.77 | 7.52 | 28.89 | 5.95 | 5.78 |
| 28 | 8.96 | 30.75 | 8.96 | 30.75 | 6.15 | 6.15 |
| 29 | 4.82 | 34.37 | 9.59 | 33.44 | 6.87 | 6.69 |
| 30 | 9.28 | 31.62 | 9.28 | 31.62 | 6.32 | 6.32 |
| 31 | 3.94 | 30.73 | 8.56 | 29.81 | 6.15 | 5.96 |
| 32 | 8.23 | 28.84 | 8.23 | 28.84 | 5.77 | 5.77 |
| 33 | 6.93 | 29.78 | 7.51 | 28.89 | 5.96 | 5.78 |
| 34 | 9.12 | 30.66 | 9.12 | 30.66 | 6.13 | 6.13 |
| 35 | 7.48 | 30.72 | 7.48 | 30.72 | 6.15 | 6.15 |
| 36 | 6.44 | 26.10 | 6.91 | 25.21 | 5.22 | 5.04 |
| 37 | 6.46 | 28.88 | 7.10 | 28.00 | 5.78 | 5.60 |
| 38 | 5.55 | 33.35 | 8.97 | 32.45 | 6.67 | 6.49 |
| 39 | 3.53 | 34.33 | 9.34 | 33.40 | 6.87 | 6.68 |
| 40 | 6.80 | 30.69 | 7.73 | 29.80 | 6.14 | 5.96 |
| 41 | 6.70 | 33.45 | 9.62 | 32.55 | 6.69 | 6.51 |
| 42 | 3.84 | 30.76 | 8.08 | 29.84 | 6.15 | 5.97 |
| 43 | 8.22 | 28.98 | 8.22 | 28.98 | 5.80 | 5.80 |
| 44 | 6.28 | 32.65 | 9.59 | 31.75 | 6.53 | 6.35 |
| 45 | 7.64 | 28.16 | 7.64 | 28.16 | 5.63 | 5.63 |
| 46 | 9.11 | 31.69 | 9.11 | 31.69 | 6.34 | 6.34 |
| 47 | 7.24 | 29.91 | 8.16 | 29.01 | 5.98 | 5.80 |
| 48 | 8.90 | 32.62 | 8.90 | 32.62 | 6.52 | 6.52 |
| 49 | 4.75 | 30.82 | 8.84 | 29.90 | 6.16 | 5.98 |
| 50 | 8.04 | 29.01 | 8.04 | 29.01 | 5.80 | 5.80 |
| 51 | 8.53 | 32.61 | 10.10 | 31.70 | 6.52 | 6.34 |
| 52 | 10.21 | 33.47 | 10.21 | 33.47 | 6.69 | 6.69 |
| 53 | 9.48 | 31.80 | 9.48 | 31.80 | 6.36 | 6.36 |
| 54 | 7.33 | 31.70 | 10.03 | 30.81 | 6.34 | 6.16 |
| 55 | 10.16 | 33.49 | 10.16 | 33.49 | 6.70 | 6.70 |
| 56 | 6.45 | 31.68 | 8.82 | 30.79 | 6.34 | 6.16 |
| 57 | 4.49 | 30.83 | 9.11 | 29.91 | 6.17 | 5.98 |
| 58 | 2.92 | 31.64 | 7.58 | 30.74 | 6.33 | 6.15 |
| 59 | 3.46 | 33.49 | 9.23 | 32.57 | 6.70 | 6.52 |
| 60 | 10.25 | 33.60 | 10.25 | 33.60 | 6.72 | 6.72 |
| 61 | 9.67 | 35.28 | 9.67 | 35.28 | 7.06 | 7.06 |
| 62 | 7.96 | 28.10 | 7.96 | 28.10 | 5.62 | 5.62 |
| 63 | 4.76 | 30.78 | 8.24 | 29.87 | 6.16 | 5.97 |
| 64 | 5.81 | 30.78 | 8.29 | 29.90 | 6.16 | 5.98 |
| 65 | 5.98 | 28.94 | 7.06 | 28.05 | 5.79 | 5.61 |
| 66 | 4.01 | 31.70 | 9.00 | 30.79 | 6.34 | 6.16 |
| 67 | 8.69 | 30.74 | 8.69 | 30.74 | 6.15 | 6.15 |
| 68 | 7.68 | 29.03 | 7.73 | 28.14 | 5.81 | 5.63 |
| 69 | 4.05 | 31.76 | 8.46 | 30.84 | 6.35 | 6.17 |
| 70 | 8.72 | 34.44 | 9.76 | 33.55 | 6.89 | 6.71 |
| 71 | 2.87 | 28.98 | 8.18 | 28.06 | 5.80 | 5.61 |
| 72 | 7.97 | 27.21 | 7.97 | 27.21 | 5.44 | 5.44 |
| 73 | 3.11 | 29.86 | 7.52 | 28.96 | 5.97 | 5.79 |

-continued

| Test No | Force at Break (N) | Elongation at Break (mm) | Force at Peak (N) | Elongation at Peak (mm) | Strain at Break (%) | Strain at Peak (%) |
|---|---|---|---|---|---|---|
| 74 | 7.93 | 28.94 | 7.93 | 28.94 | 5.79 | 5.79 |
| 75 | 3.75 | 36.19 | 10.05 | 35.28 | 7.24 | 7.06 |
| 76 | 3.24 | 32.63 | 9.05 | 31.71 | 6.53 | 6.34 |
| 77 | 9.33 | 33.50 | 9.33 | 33.50 | 6.70 | 6.70 |
| 78 | 7.54 | 28.03 | 7.54 | 28.03 | 5.61 | 5.61 |
| 79 | 8.65 | 30.81 | 8.65 | 30.81 | 6.16 | 6.16 |
| 80 | 7.02 | 27.23 | 7.02 | 27.23 | 5.45 | 5.45 |
| 81 | 8.56 | 31.73 | 9.18 | 30.80 | 6.35 | 6.16 |
| 82 | 8.00 | 34.42 | 9.26 | 33.51 | 6.88 | 6.70 |
| 83 | 7.15 | 31.77 | 9.19 | 30.88 | 6.35 | 6.18 |
| 84 | 9.18 | 32.67 | 9.18 | 32.67 | 6.53 | 6.53 |
| 85 | 4.45 | 32.59 | 8.87 | 31.67 | 6.52 | 6.33 |
| 86 | 2.63 | 28.12 | 7.37 | 27.21 | 5.62 | 5.44 |
| 87 | 7.88 | 29.02 | 7.88 | 29.02 | 5.81 | 5.81 |
| 88 | 3.73 | 29.82 | 8.01 | 28.91 | 5.96 | 5.78 |
| 89 | 9.72 | 34.37 | 9.72 | 34.37 | 6.87 | 6.87 |
| 90 | 6.18 | 31.65 | 8.60 | 30.76 | 6.33 | 6.15 |
| 91 | 9.40 | 32.70 | 9.40 | 32.70 | 6.54 | 6.54 |
| 92 | 7.33 | 27.18 | 7.33 | 27.18 | 5.44 | 5.44 |
| 93 | 7.32 | 26.25 | 7.32 | 26.25 | 5.25 | 5.25 |
| 94 | 3.50 | 29.04 | 7.08 | 28.13 | 5.81 | 5.63 |
| 95 | 8.19 | 30.82 | 8.88 | 29.92 | 6.16 | 5.98 |
| 96 | 4.35 | 29.88 | 8.51 | 28.97 | 5.98 | 5.79 |
| 97 | 8.09 | 29.92 | 8.09 | 29.92 | 5.98 | 5.98 |
| 98 | 9.54 | 31.76 | 9.54 | 31.76 | 6.35 | 6.35 |
| 99 | 3.32 | 29.87 | 7.87 | 28.96 | 5.97 | 5.79 |
| 100 | 9.72 | 35.36 | 10.73 | 34.46 | 7.07 | 6.89 |
| Min | 2.63 | 26.10 | 6.91 | 25.21 | 5.22 | 5.04 |
| Mean | 6.85 | 31.34 | 8.77 | 30.82 | 6.27 | 6.16 |
| Max | 10.88 | 37.06 | 11.24 | 37.06 | 7.41 | 7.41 |
| S.D. | 2.26 | 2.32 | 0.98 | 2.29 | 0.47 | 0.46 |
| C. of V. | 33.02 | 7.41 | 11.12 | 7.44 | 7.41 | 7.44 |
| L.C.L. | 6.40 | 30.88 | 8.58 | 30.36 | 6.18 | 6.07 |
| U.C.L. | 7.29 | 31.80 | 8.96 | 31.27 | 6.36 | 6.25 |

INDUSTRIAL APPLICABILITY

The fiber obtained in the method for which the application is made has a quality that enables it to be used in the production of a wide range of yarn on existing spinning equipment, non-woven materials and various items used for technical, mechanical and everyday purposes.

The invention claimed is:

1. A method of processing unscutched bast-fiber materials, comprising a woody part, cellulose, and encrusting substances, so as to elicit elementary fibers, comprising, in sequence, steps of:

a. feeding raw materials comprising intermediate products of bast-fiber materials after biological enzyme treatment without subsequent mechanical scutching into a bale-breaker with a loosener;

b. feeding the raw materials from said bale breaker with the loosener into a metering system;

c. biochemically treating the raw materials;

d. generating pulsed electric discharges between two electrodes disposed within a chamber containing a liquid medium and the biochemically treated raw materials so as to effectively generate enhanced hydraulic pressures and mechanical actions within the liquid medium, including shock waves and cavitation, which will tend to separate bast-fiber products from the raw materials, wherein said enhanced hydraulic pressures and mechanical actions result in generation of a discharge channel which expands at a rate of over 100 m/s and processing the biochemically treated raw materials in the chamber;

e. rinsing the bast-fiber products with emulsifying reagents; and f. washing and pressing the bast-fiber products followed by loosening, final drying and fine loosening so as to obtain elementary fibers which retain the length, diameter and ordered crystalline structure of the cellulose in the bast-fiber material.

2. The method according to claim 1, wherein the step of processing the biochemically treated raw material using a pulse electric discharge in a liquid medium causes separation of woody parts and encrusting substances from the elementary fibers.

3. The method according to claim 1, wherein the liquid medium is water.

4. The method according to claim 1, which further comprises a step of removing the used liquid medium using a filtration step prior to step (e).

5. The method of claim 1, wherein the pulsed electric discharge has either (A) an energy of 2.2 kJ and is applied for 400 discharges; or (B) an energy of 3.6 kJ and is applied for between 100 and 200 discharges.

6. A method of processing unscutched bast-fiber materials, comprising a woody part, cellulose, and encrusting substances, so as to elicit elementary fibers, comprising, in sequence, steps of:

a. feeding raw materials comprising intermediate products of bast-fiber materials after biological enzyme treatment without subsequent mechanical scutching into a bale-breaker with a loosener;

b. feeding the raw materials from said bale breaker with the loosener into a metering system;

c. biochemically treating the raw materials;

d. generating either (A) 400 pulsed electric discharges each having an energy of 2.2 kJ or (B) between 100 and 200 pulsed electric discharges each having an energy of 3.6 kJ, between two electrodes disposed within a chamber containing a liquid medium and the biochemically treated raw materials so as to effectively generate enhanced hydraulic pressures and mechanical actions within the liquid medium, including shock waves and cavitation, which will tend to separate bast-fiber products from the raw materials, and processing the biochemically treated raw materials in the chamber;

e. rinsing the bast-fiber products with emulsifying reagents; and f. washing and pressing the bast-fiber products followed by loosening, final drying and fine loosening so as to obtain elementary fibers which retain the length, diameter and ordered crystalline structure of the cellulose in the bast-fiber material.

7. The method according to claim 6, wherein the step of processing the biochemically treated raw material using a pulse electric discharge in a liquid medium causes separation of woody parts and encrusting substances from the elementary fibers.

8. The method according to claim 6, wherein the liquid medium is water.

9. The method according to claim 6, which further comprises a step of removing the used liquid medium using a filtration step prior to step (e).

* * * * *